US005933932A

United States Patent [19]

Watanabe et al.

[11] Patent Number: 5,933,932

[45] Date of Patent: Aug. 10, 1999

[54] APPARATUS FOR MAKING ELECTRICAL HARNESS

[75] Inventors: Souichi Watanabe, Yokohama; Yoshio Ishiwata, Isehara; Kazuaki Kamei, Yamato; Masahiro Ohsawa, Yokohama, all of Japan

[73] Assignee: Molex Incorporated, Lisle, Ill.

[21] Appl. No.: 08/879,762

[22] Filed: Jun. 20, 1997

[30] Foreign Application Priority Data

Jun. 28, 1996 [JP] Japan ..... 8-188401

[51] Int. Cl.[6] ..... B21B 15/00

[52] U.S. Cl. ..... 29/33 M; 29/564.6; 29/566.2; 29/749; 29/755

[58] Field of Search ..... 29/33 M, 566.1, 29/566.2, 566.3, 564.3, 857, 749, 751, 755, 564.4, 564.6

[56] References Cited

U.S. PATENT DOCUMENTS

| | | | |
|---|---|---|---|
| 3,872,584 | 3/1975 | Chick et al. | 29/564.4 |
| 4,165,768 | 8/1979 | Gudmestad | 29/564.4 |
| 4,166,315 | 9/1979 | Gudmestad et al. | 29/564.4 |
| 4,404,743 | 9/1983 | Brandewie et al. | 29/755 |
| 4,581,796 | 4/1986 | Fukuda et al. | 29/564.4 |
| 4,932,110 | 6/1990 | Tanaka | 29/564.4 |
| 5,159,749 | 11/1992 | Weigert et al. | 29/755 |
| 5,471,741 | 12/1995 | Heisner et al. | 29/755 |

*Primary Examiner*—Daniel W. Howell
*Assistant Examiner*—Christopher Kirkman
*Attorney, Agent, or Firm*—Charles S. Cohen

[57] ABSTRACT

A wire harness-making apparatus includes a wire supply, a wire feeding unit for feeding and measuring harness wires from the wire supply, a wire transport unit for transporting the harness wires, and two connector crimping units positioned on the opposite sides of the harness wire set. The wire transport unit includes first and second wire clamps movable from opposite sides of the harness wires. The first and second wire clamps are driven along an associated top and bottom guides on opposite sides of the harness wire set. These clamps may he operated into and out of contact from vertical directions so as not to interfere with the feeding of wires by the wire feed unit.

12 Claims, 8 Drawing Sheets

APPARATUS FOR MAKING ELECTRICAL HARNESS

BACKGROUND OF THE INVENTION

The present invention relates to both methods of making wire harnesses and apparatus for making wire harnesses wherein the wire harness making apparatus includes an improved harness wire transport assembly.

Wire crimping apparatus have been used in the making of wire harnesses for some time. Such apparatus have been used to make wire harnesses that include a set of harness wires of a predetermined length and a set of electrical connectors connected to opposing free ends of the harness wires. A typical harness-making apparatus includes a wire supply, a wire measure and feed means for feeding a predetermined length of a set of harness wires from the wire supply, means for terminating connectors to the free ends of the wire harness set, means for cutting the harness wires to a specified length, and wire transporting means for holding the harness wires in place and transporting the harness wire set from the wire feeding means to the connector terminating means, downstream of the wire transporting means, whereat connector housings are terminated to the opposing free ends of the harness wire set, such as by crimping.

In such apparatus, the wire feeding means and the connector terminating means are arranged side-by-side transversely to the direction in which the wires are fed. Therefore, the wire transporting means is designed so to reciprocate between the wire feeding means and the connector terminating means transversely relative to the wire feed direction.

However, in the making of wire harnesses with such apparatus, the wire feeding means ceases operation for a time while the harness wire set is transported from its location immediately ahead of the wire feeding means to the connector terminating means, where connectors are terminated to opposing ends of the harness wire set. The wire feeding means lies dormant in a stand-by position until the connector termination has been completed. This dormancy is necessitated by the back and forth reciprocal movement of the wire transporting means across the feedpath of the wire feeding means, thus preventing the wire feeding means from operating during movement of the wire harness set to its termination location.

This dormancy is a disadvantage in the production of wire harnesses, because it lowers the efficiency with which harnesses can be made. There has been an increasing demand for the continuous working of wire feeding means because it takes relatively more time to feed and measure the harness wires in their discrete sets, as compared with the other wire harness assembly steps.

The present invention overcomes this disadvantage and virtually eliminates the dormancy of the wire feeding means by redirecting the movement of the harness wire set transporting means out of the feedpath of the wires.

SUMMARY OF THE INVENTION

Accordingly, it is a general object of the present invention to provide a method of making harnesses with an increased efficiency.

Another object of the present invention is to provide an improved wire transport means used in a wire harness-making apparatus for transporting a set of cut harness wires from a wire feed location to a connector termination location, the wire transport means having a movement that does not interfere with, or cross, the feedpath of the wire feeding means.

To attain these objects and advantages, a wire transport means is designed to cause no interference with the operation of the wire feed means and thereby permit the continuous operation of the wire feed means while connectors are connected to the opposite ends of the wires of the harness wire set. In this regard, the wire transport means engages a harness wire set from opposite sides of the wire set and thereupon moves the set of harness wires out of the wire feedpath of the wire feeding means. The wire transport means engages the harness wire set from opposite sides of the harness wires and in doing, avoids interference with the wire feedpath of the wire feeding means.

The invention includes a method of making harnesses utilizing the sets of feeding a set of harness wires from a wire supply and measuring each of the fed wires to achieve a predetermined length of harness wires, cutting the harness wire set to form a discrete set of harness wires; gripping the harness wire set and transporting the harness wire set from the wire feedpath, along a wire harness assembly path to a connector terminating means and applying connectors to opposing ends of the harness wire set, and while the connectors are being connected to the opposing ends of the harness wire sets, the wire feed means is effecting another subsequent feeding and measuring of a harness wire set.

An improved wire harness-making apparatus a plurality of wire reels in accordance with the inventor includes: a wire feed means for feeding wires from a wire supply and measuring the wires as they are fed therefrom, a wire transport means for transporting the set of harness wires after their feeding; and, connector terminating means positioned on the opposite sides of the wire harness assembly path for terminating connectors to opposing ends of the harness wire sets.

In one aspect of the present invention, the wire transporting means includes a first wire clamp movable above the harness wires fed from the wire feeding means and a second wire clamp movable below the harness wires. In the preferred embodiment, the first clamp is operatively connected to a moveable head and driven along an associated upper guide rail perpendicular to the wire feedpath and the second wire clamp is operatively connected to a movable base driven along an associated lower guide rail extending perpendicular to the wire feed path. The first and second clamps are aligned together and move in unison with each other to transport serial harness wire sets from the wire feeding means to the connector terminating means. The first and second clamps are capable of spreading apart from each other to return from the connector to the wire harness-making feeding means.

In another aspect of the invention, the wire apparatus further comprises means to separate the first and second wire clamps form a coupled in the engagement condition in which these parts are put on each other to hold the electric wires therebetween.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
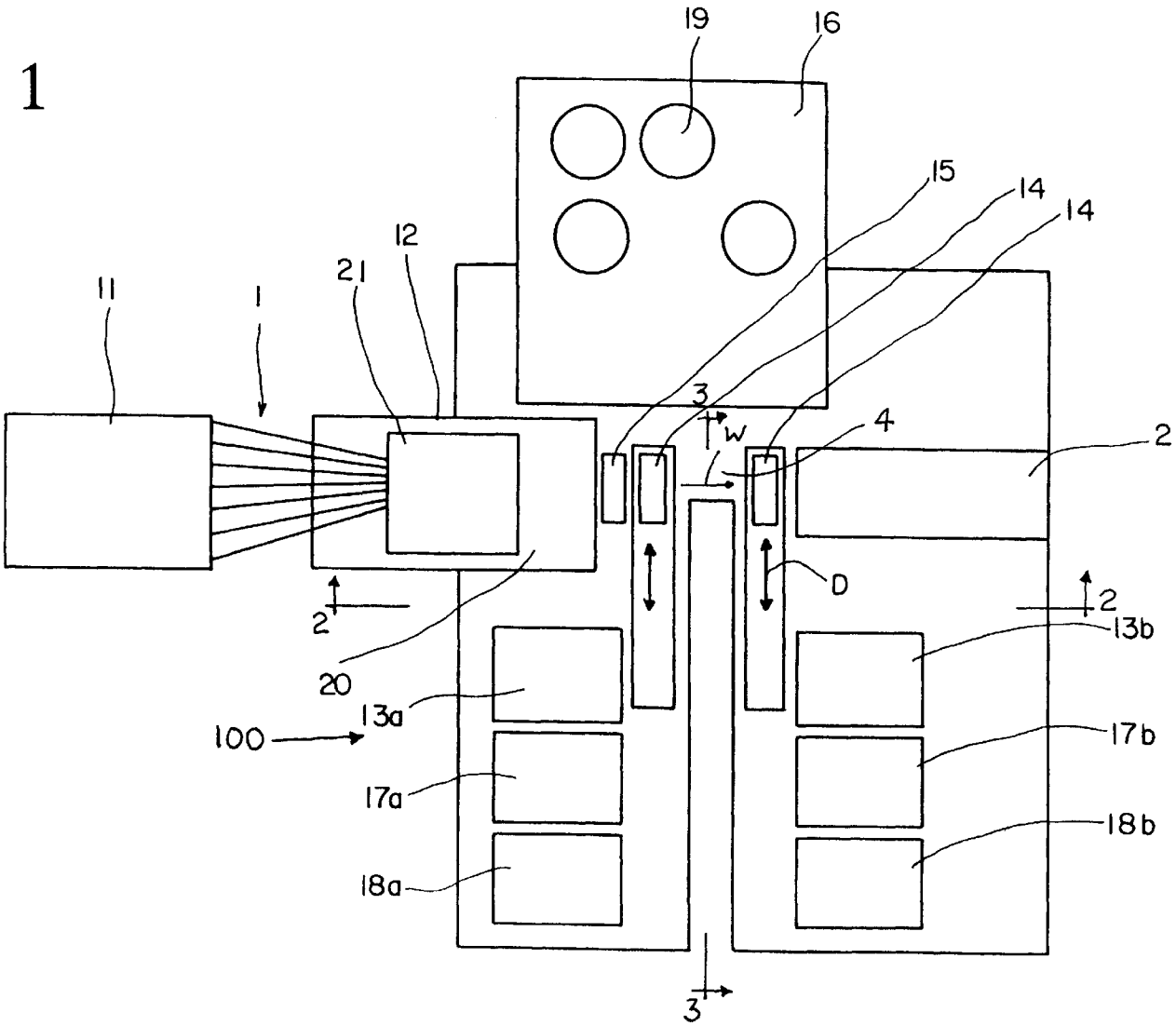
FIG. 1 is a plan view of a wire harness-making apparatus constructed in accordance with the principles of the present invention.

Referring to FIG. 1, a wire harness making apparatus constructed in accordance with the present invention is shown generally at 100 and includes a wire supply in the form of a plurality of wire reels 11, each such supply reel having a supply of wire 1 wound therearound, a wire feeding means 12 for feeding wires 1 from the wire supply reels 11. As the wire feeding means feeds the wires, it also measures the length of the wire fed out through the feeding means for selected predetermined lengths. A wire pulling means 2 is positioned forward of the wire feeding means 12 to assist in the wire feed process and is spaced apart from the wire feeding means 12 to define a wire feed space, or opening 4, therebetween.

Figure 2:
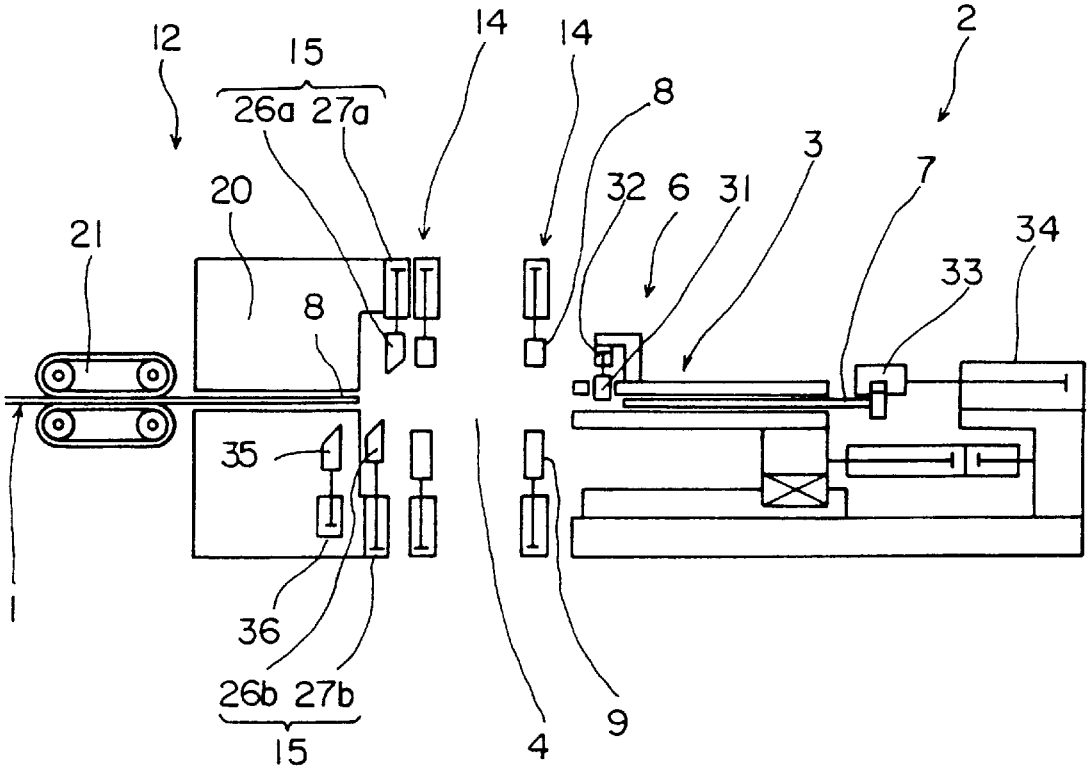
FIG. 2 is a frontal elevational view of the wire harness-making apparatus of FIG. 1 taken along lines 2—2 thereof.
Figure 6:
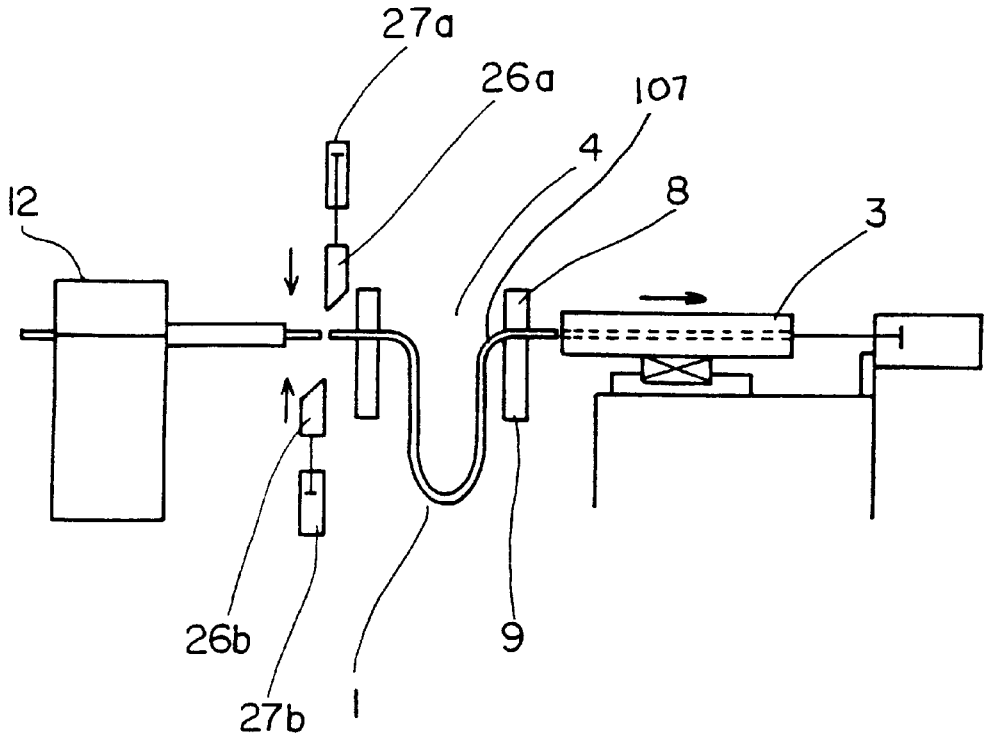
FIG. 6 is an abbreviated frontal view illustrating how the harness wire set is cut while held by the wire transporting means.

Depending on the length desired for the wire harness, the wires may or may not be "looped" into the wire feed space 4 as is known in the art and as shown in FIG. 6. The wire feeding means 12 may include, as shown in FIG. 2, a feed belt conveyor 21 driven by a servomotor in order to measure the length of electric wires 1 fed. A wire-to-wire interval setting mechanism 20 is also provided and preferably includes a wire pitch changer 35 driven by an associated drive assembly, illustrated as a piston-and-cylinder drive 36 as shown. The wire pitch changer 35 is preferably selectively utilized to change the wire-to-wire spacing, or "pitch", between adjacent wires in order to match the pitch on the connector elements 5 applied to the harness wires.

The wire pulling means 2 may also include a movable guide member 3 which may be moved toward and away from the wire feeding means 12 and an engagement member 31 fixed to the guide member 3, near the front thereof. The engagement member 31 is driven by a drive assembly, such as the piston-and-cylinder drive assembly 32 illustrated. The guide member 3 may includes a means for stopping 6 the wires in a specific alignment, utilizing pins 7 thereon that engage one set of the free ends of the harness wire sets prior to cutting. Such alignment pins are driven in their operation by an associated piston-and-cylinder drive assembly 34.

The wire harness apparatus further comprises a wire transport means 14 for transporting each harness wire set after a predetermined length thereof has been fed from the wire feeding means 12 to a connector terminating means 13*a*, 13*b*. The connector terminating means 13*a*, 13*b* is provided for terminating connector elements 5 to opposing free ends of the harness wire sets. In order to provide a continuous supply of connector elements 5 to the connector terminating means 13*a*, 13*b*, a connector element storage area 16 is provided with a part feeder 19 and positioned alongside the wire feed space 4 so that it may feed connector elements 5 to the connector terminating means 13*a* and 13*b*.

The connector terminating means 13*a*, 13*b* are positioned on the other, opposite side of the wire feed space 4 with respect to the connector housing storage 16. The wire transport means 14 holds a set of harness wires of predetermined lengths near their opposing free ends and moves them along an assembly path indicated by the arrow D in FIG. 1 in order to transport, or transfer, them downstream from the wire feed space 4 to an intervening space 102 between the right and left connector terminating means 13*a* and 13*b*. A wire harness testing means 17*a*, 17*b* and a wire harness rejection means 18*a*, 18*b* are positioned in serial order downstream of the connector terminating means 13*a*, 13*b*. These various means are located along a wire harness assembly path D, that as explained below, runs transversely, or perpendicularly to the wire feed path W of the wire feeding means 12.

A wire cutting means 15 is best illustrated in FIG. 2 and is disposed in the feed path of the harness wires 1. This cutting means is provided to cut the wires fed by the wire feeding means 12 in order to define, in serial order, discrete sets of harness wires. The cutting means 15 includes a first cutting blade 26*a* driven by an associated piston-and-cylinder drive assembly 27*a* and a second cutting blade 26*b* driven by an associated piston-and-cylinder drive assembly 27*b*. The cutting means 15 is preferably positioned on the upstream side of the wire feed path W (FIGS. 1 & 2) so as not to interfere with the wire transport means 14.

Figure 3:
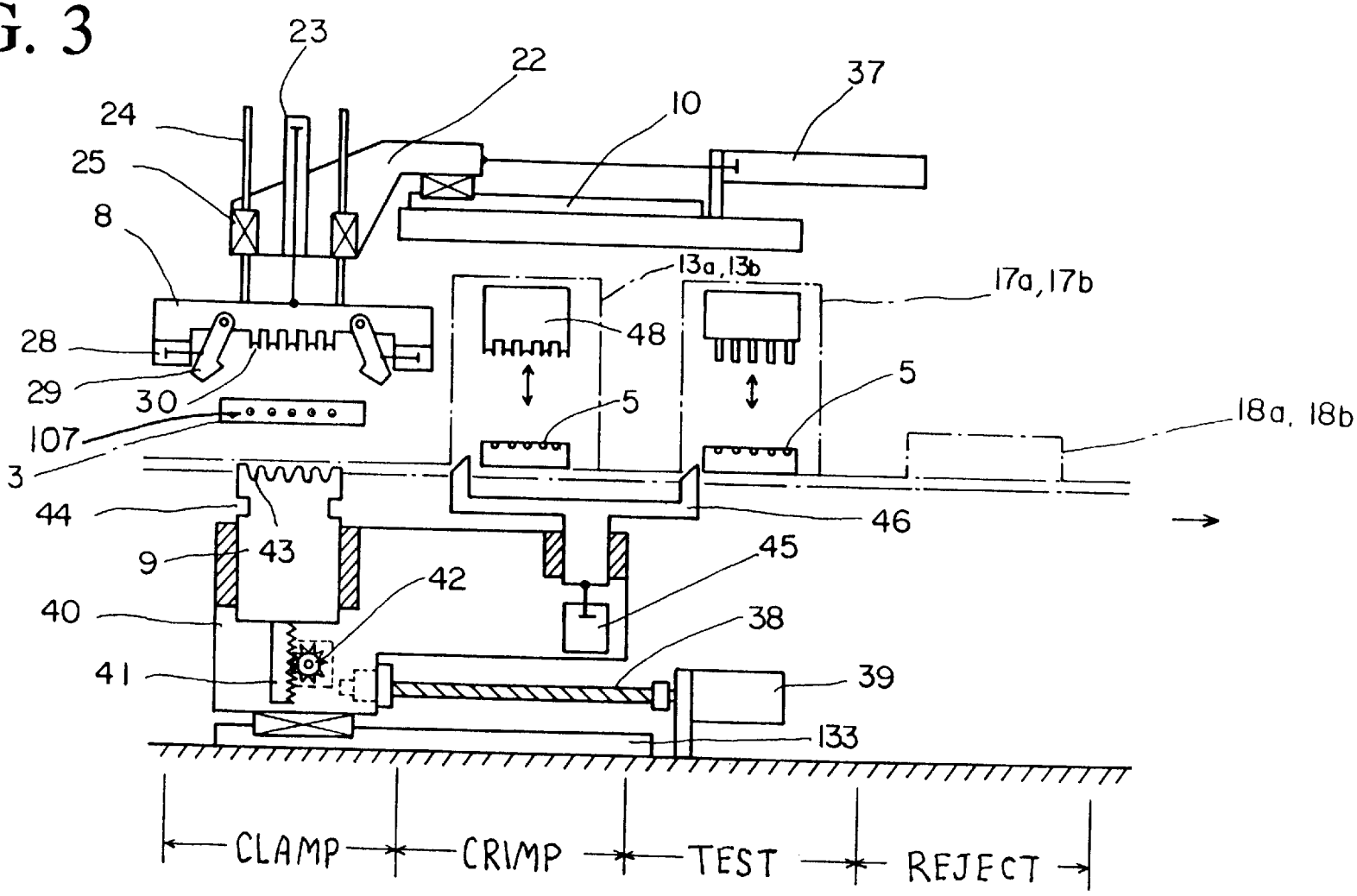
FIG. 3 is an elevational view of the wire transporting means of the wire harness-making apparatus of FIG. 1 taken along lines 3—3 thereof.

One essential aspect of the wire harness-making apparatus of the present invention resides in the structure and operation of the wire transport means 14. As shown in FIG. 3, the wire transport means includes a first wire clamp 8 disposed above the level of the get of harness wires 1 and a second wire clamp 9 disposed below the harness wire set 1. These first and second clamps are operable between ready positions (shown to the left of FIG. 3) and terminating positions (shown to the Left in FIGS. 7 & 8). As can be seen, the first and second clamps 8, 9 lie on opposite sides of the harness wire set.

The first clamp 8 is driven on movable head 22 by an associated piston-and-cylinder drive assembly 37 along an upper guide rail 10 that extends at an angle to the feed path W along which the harness wires are fed by the wire feeding means 12. Preferably, the first and second clamps are oriented perpendicular to the feed path W. The first wire clamp 8 is further movably mounted to the head 22 by an additional drive assembly, such as a piston-and-cylinder drive assembly 23, so that the first wire clamp 8 may be driven in another direction during operation of the apparatus 100. This direction of operations vertical and the first clamp 8 reciprocates toward and away from the harness wire set. In this regard, the head 22 may include linear guides 25 that will permit the controlled vertical movement of the first wire clamp 8.

A movable base 40 is provided beneath the level of the harness wire set and may be driven in a reciprocating fashion like the head 22 by an associated linear drive means, such as the drive screw 38 and a servomotor 39 illustrated in FIG. 3. The base 40 is moved along an associated lower guide rail 133 that extends perpendicular to the wire feeding direction W, but along the wire harness assembly path D to move the second wire clamp 9 in its movement. The second wire clamp 9 is also capable of vertical movement so that it may be selectively moved into and out of contact with the harness wire set disposed thereabove. This reciprocating movement is accomplished by a drive means, such as the associated rack 41 and pinion gear 42 illustrated in FIG. 3.

The first wire clamp 8 is preferably equipped with latches 29, which are actuated between opened and closed positions by an associated piston-and-cylinder drive assembly 28. The first wire clamp 8 has a series of wire-clamping teeth 30 formed between the latches 29. The second wire clamp 9 has grooves 43 formed on its upper surface, so that the wire engagement teeth 30 of the first clamp 8 may be aligned with and in the grooves 43 of the second wire clamp 9 when the two clamps 8 and 9 mate together. In order to effectuate proper coupling of the first and second wire clamps 8,9, the second clamp 9 preferably includes a pair of slots 44 formed on its opposite sides so that the latches 29 of the first wire clamp 8 will catch the opposing slots 44 of the wire clamp 9 when the two wire clamps 8 and 9 mate together. This coupling holds the harness wires in place as a set while they are transported from the wire feed path W to the connector terminating means 13*a*, 13*b*.

Figure 7:
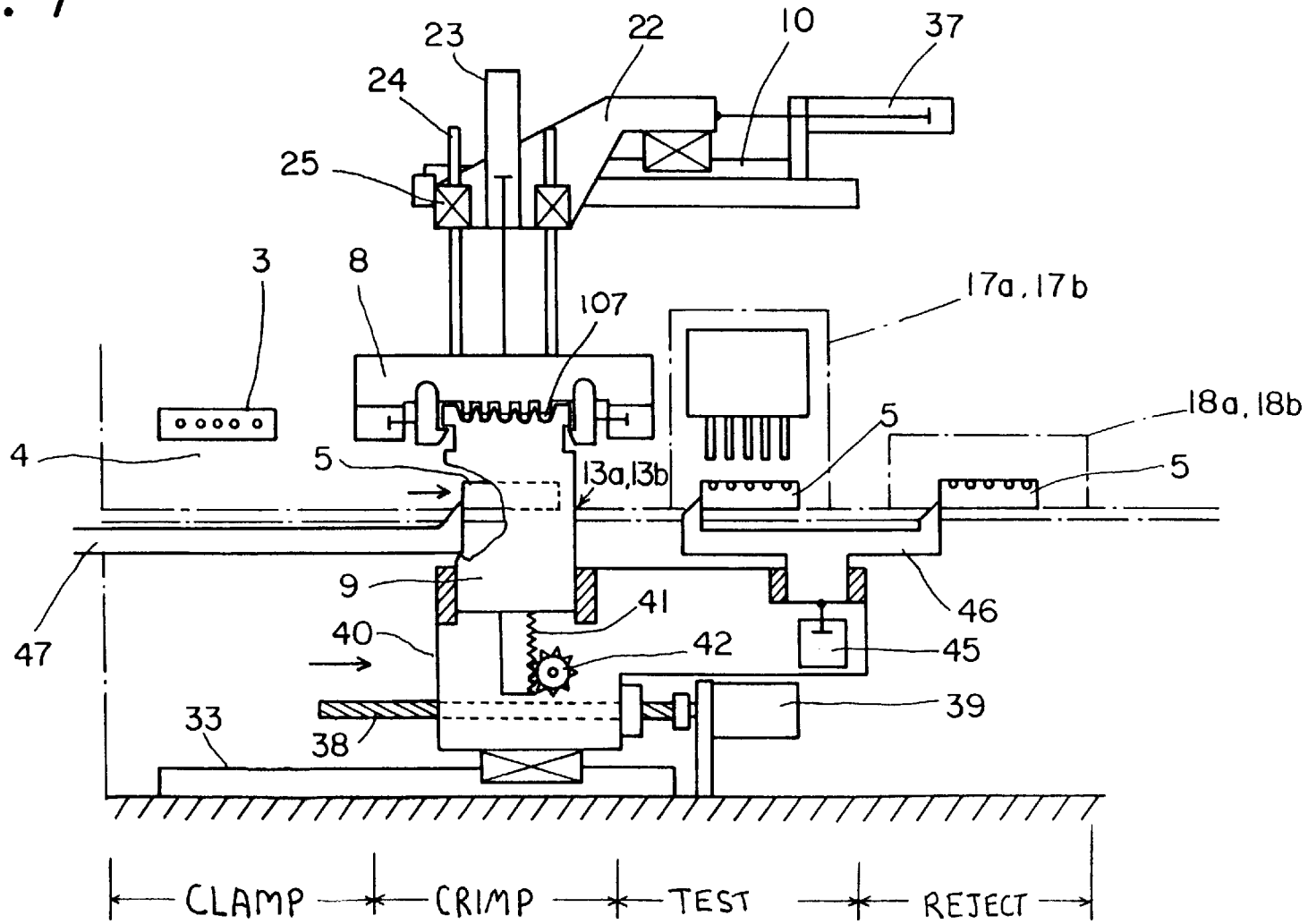
FIG. 7 is the same elevational view as FIG. 3, but illustrating how the harness wire set is moved to the connector by the wire transporting means.
Figure 8:
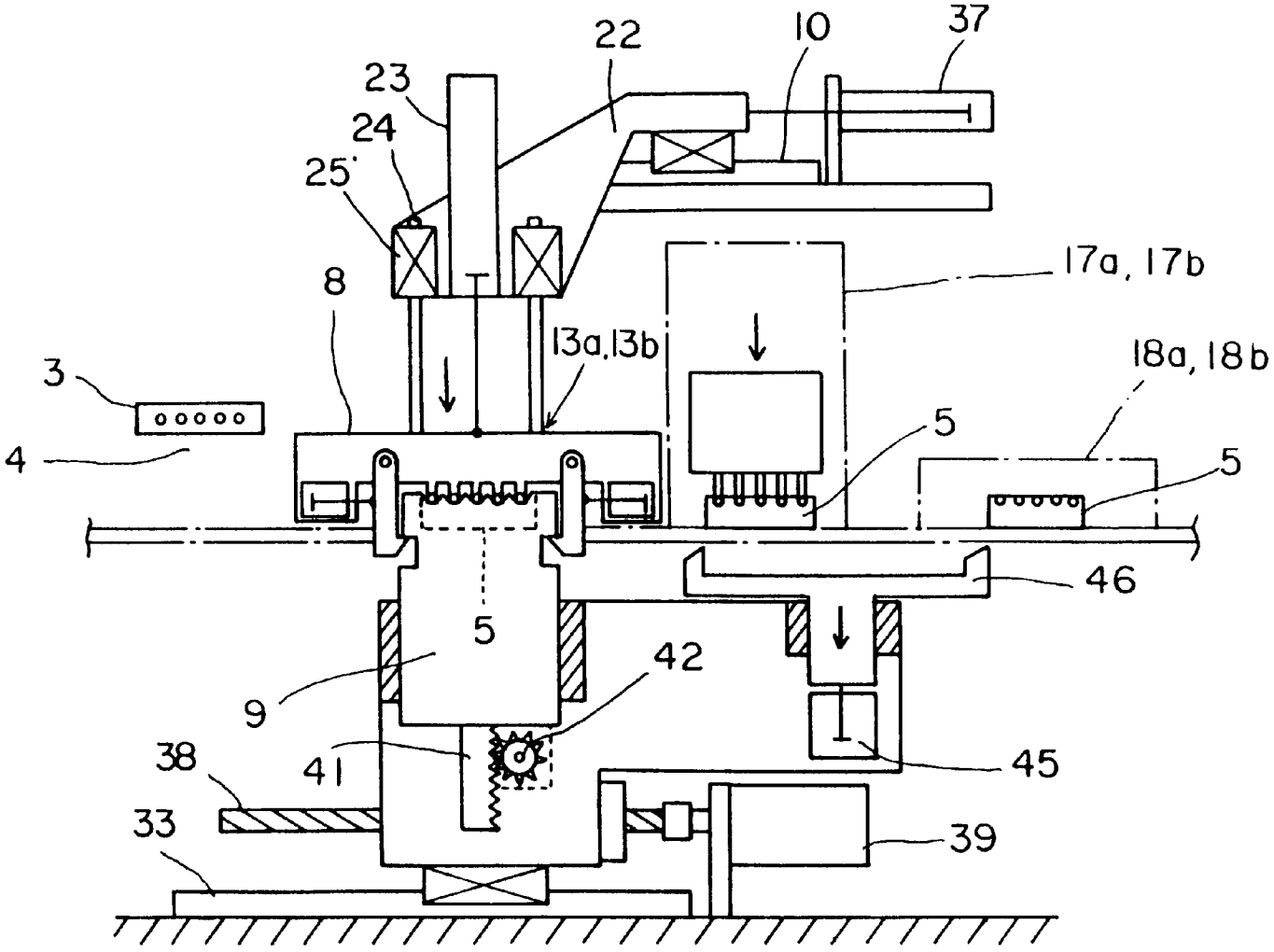
FIG. 8 is the same view as FIG. 8 illustrating how the electric connectors are terminated to opposite ends of the harness wire set held by the wire transporting means; and, FIG. 9 is the same view as FIG. 8, but illustrating how the wire terminating means works after having connected the electric connector housings to the wires held by the wire holding-and-transporting unit.

The lower base 40 of the wire transport means 40 includes a connector element advancement means in the form of a harness shuttle 46 mounted toward in its right end. (FIG. 7) This harness shuttle 46 may be lowered and raised by an associated piston-and-cylinder drive assembly 45. When the base 40 moves, connector elements 5 that have been previously advanced to the connector terminating means 13*a*, 13*b* are likewise moved from the connector housing terminating means 13*a* and 13*b* to the wire harness testing means 17*a*and 17*b*. Simultaneously, tested connector elements at the testing means 17*a*, 17*b* are then shifted as shown in FIG. 7 from the testing means 17*a*, 17*b* to the harness rejection verification means 18*a* and 18*b*.

Figure 4:
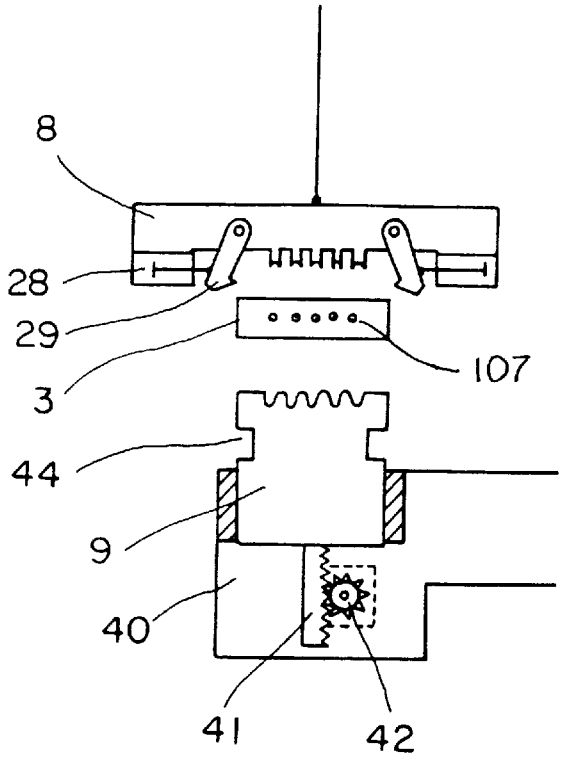
FIG. 4 is a detail end view illustrating the wire transporting means in a ready condition as it awaits for completion of the feeding of a set of harness wires.

Referring now to FIG. 4 and subsequent drawings, the method of making harnesses utilizing the wire harness making apparatus of the present invention shall be described. First, the first and second wire clamps 8, 9 are placed into a "ready" or "stand-by" position where they are moved away from the wire feed path W. In this regard, the first wire clamp 8 is raised and the second wire clamp 9 is lowered (FIG. 4. ) as the two clamps 8, 9 await the arrival of a set of harness wires fed from the wire feeding means 12. At this time, the wire feeding means 12 draws wires 1 off of the wire supply reels 11 in conjunction with the wire pulling means 2 to feed a predetermined length of wire into the wire feed space 4 to define a set of harness wires.

Figure 5:
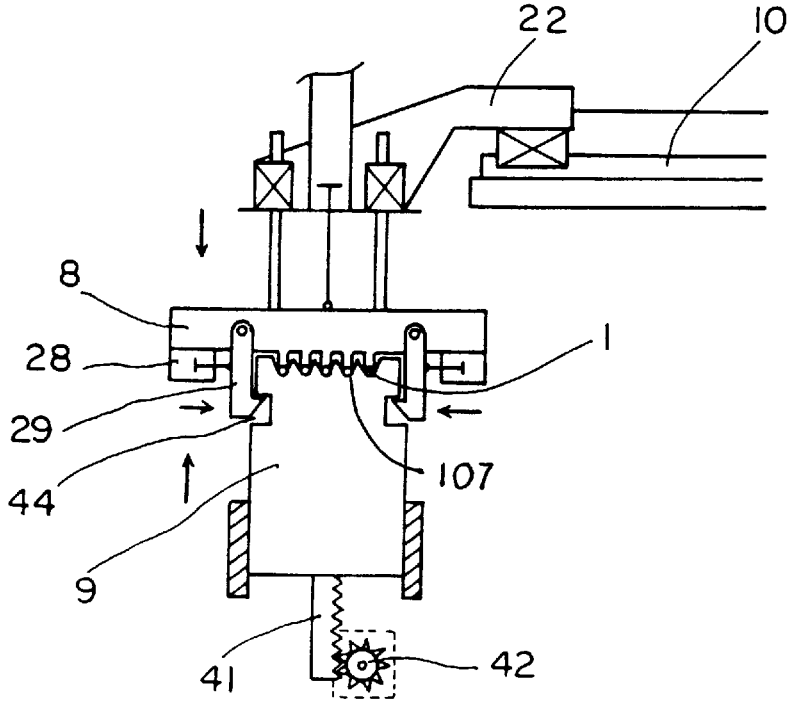
FIG. 5 is a detailed view of the harness-making apparatus illustrating the wire transporting means in a coupled condition wherein it holds the harness wire set in place for transport.

After the wires 1 are fed along the wire feed path W to form a set of harness wires, the first wire clamp 8 is lowered by its drive assembly 23 and the second wire clamp 9 is raised by movement of its pinion gear 42. In this manner, the harness wire set 107 is thereby held between the teeth 30 of the first wire clamp 8 and the grooves 43 of the second wire clamp 9. Then the clamps 8 and 9 are coupled by closing them and engaging the latches 29 of the first wire clamp 8 with the opposing slots 44 of the second wire clamp 9, as shown in FIG. 5.

After the harness wire set is held by the two clamps 8, 9, the wires thereof are cut near the wire feeding means 12 by the cutting blades 26*a* and 26*b*, as seen in FIG. 6 to define a set of trailing free ends of the wire set. At the same time, the leading free ends of the electric wires 1 are released from the wire pulling means 2 so that a single set of harness wires are formed that is held by the wire transport means 14.

Next, the wire transport means 14 is activated and the linear drive, i.e., the drive screw 38 and servomotor 39 are actuated to carry the coupled first and second clamps 8 and 9 that hold the wire set 1 therebetween to the connector terminating means 13*a* and 13*b*, as shown in FIG. 7. The connector elements 5 of the preceding wire harness set in place at the connector terminating means 13*a* and 13*b* are then shifted in serial order to the harness testing means 17*a* and 17*b* by the harness shuttle 46 and the connector elements 5 previously at the testing means 17*a* and 17*b* are likewise shifted to the harness rejection means 18*a* and 18*b* by the harness shuttle 46. In synchronization with this shifting, new connector elements are fed from their storage area 16 to the connector terminating means 13*a* and 13*b* by the connector loader 47. Because the wire feed space 4 is not yet occupied by any harness wires 1, the feeding of harness wires 1 occurs concurrently with the shifting of the harness wire set to the connector terminating means 13*a* and 13*b* by the first and second wire clamps 8, 9 of the wire transport means 14.

Figure 9:
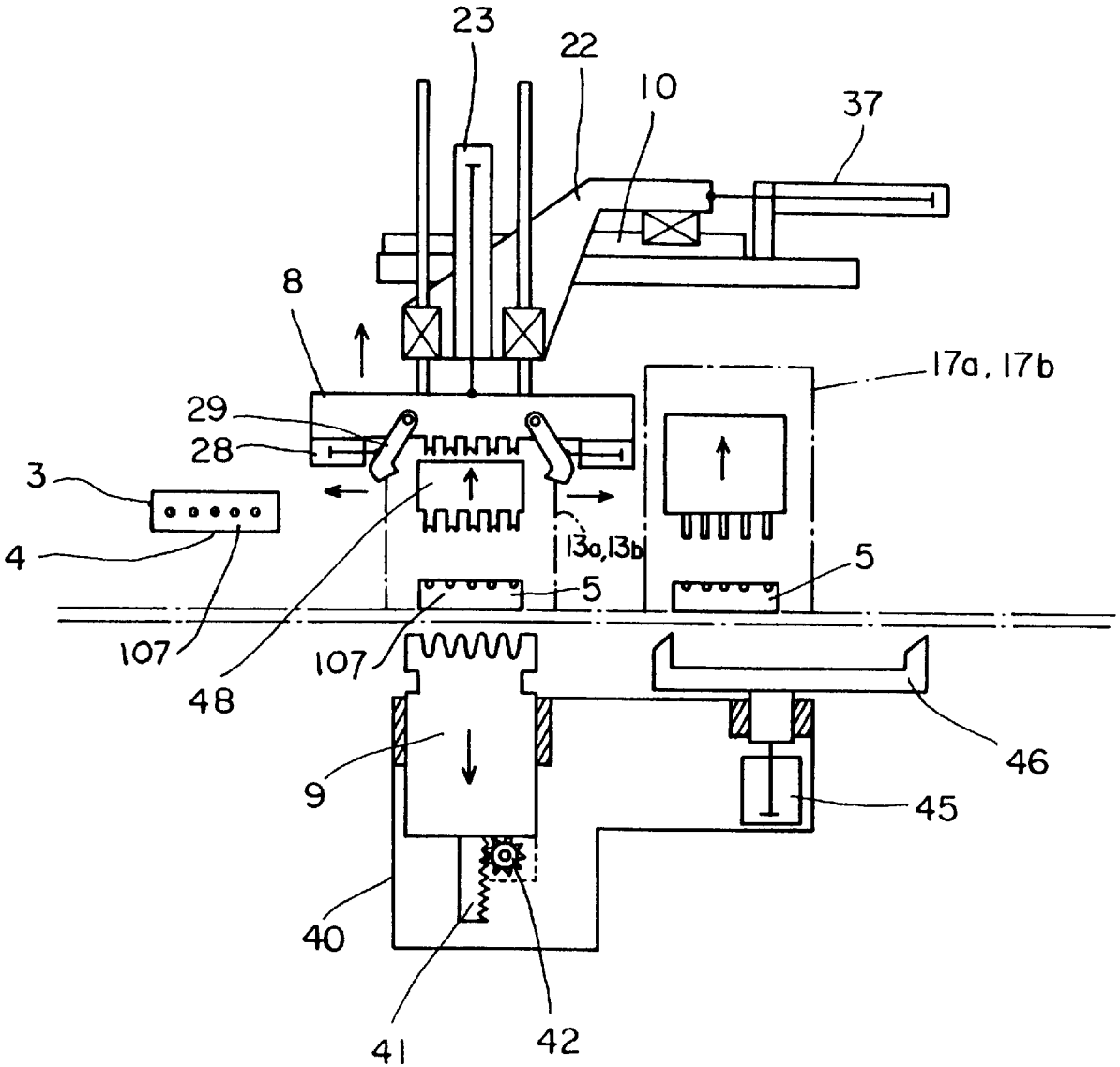

While a subsequent feeding of a harness wire set is being effected, the harness wires 1 previously shifted to the connector terminating means 13*a* and 13*b* are thereupon terminated to the connector elements 5, such as by crimping, to form a completed wire harness. The completed harnesses pass, in serial order, downstream along the harness assembly path, through the harness testing means 17*a* and 17*b* and the rejection means 18*a* and 18*b*, where defective harnesses, if any, are identified and rejected. Referring to FIG. 9, connector elements 5 are connected to the harness wires 1 in the embodiment illustrated by lowering termination members, illustrated in the preferred embodiment as a crimper 48 having wire-contacting teeth, provided in each of the connector terminating means 13*a* and 13*b*. The contact made by the crimpers 48 terminates the harness wires 1 to the connector elements 5 in a conventional manner, such as by insulation displacement.

In terminating, the pinion gear 42 is rotated in synchronization with the descent of the crimper 48 so that the wire clamps 8 and 9 are slightly lowered. This synchronization has the effect of preventing the harness wires 1 from bending at their transition portions which occur between the crimping teeth 48 and the engagement portions of the wire clamps 8, 9. Also, the lengths of the harness wires 1 that extend from the wire clamps 8, 9 to their free ends which are connected to the connector elements 5 may be reduced to minimum as required, preventing irregularity in the wire ends or non-linearity in the wire lengths. Thus, the terminal pieces can be crimped to the wire ends in good condition.

Subsequent to the termination of the harness wires 1 to the connector elements 5, the piston-and cylinder 28 is operated so that the latches 29 of the clamp 8 are opened and disengage with the oppossing slots 44 of the second wire clamp 9, thus uncoupling the first and second wire clamps 8, 9. Then their respective drive assemblies are operated so that the first wire clamp 8 is raised and the second wire clamp 9 is lowered, to thereby release the completed wire harness from the wire transport means 14. The crimper 48 is also raised up to a stand-by position.

At the time of this release, a set of harness wires 1 from the wire feeding means 12 appear at the wire feed space 4. Therefore, the drive assemblies are operated so that the first and second wire clamps 8, 9 are shifted to the wire feed space 4 in unison. Then the same proceeding as described above is repeated to produce an additional wire harness.

As may be understood from the above, in making harnesses according to the present invention harness wires are terminated to connector elements, and subsequent sets of harness wires are measured and fed concurrently. The present invention does not require that the wire feeding means be taken out of operation and put in a dormancy, or stand-by position. Accordingly, wire harnesses can be made at an increased efficiency.

In a wire harness-making apparatus according to the present invention, the wire transport means is so constructed as to cause no interference with the wire feed path W or wire feed space, and therefore, subsequent feeding of harness wires can be started concurrently with the shifting of harness wires from the wire feed space to the connector terminating means. Accordingly, harnesses can be made at an increased efficiency.

While the preferred embodiment of the invention have been shown and described, it will be apparent to those skilled in the art that changes and modifications may be made therein without departing from the spirit of the invention, the scope of which is defined by the appended claims.

We claim:

1. An apparatus for making wire harnesses, each of the wire harnesses having a set of wires extending between two connector elements, the apparatus comprising: a wire supply, means for feeding preselected lengths of wire from said wire supply along a wire feed path of said apparatus, a harness assembly path extending at an angle to said wire feed path, means for cutting said lengths of wire to define a set of harness wires having free wire ends on opposite ends of the harness wire set, means for terminating connector elements to said harness wire set free ends, and means for transporting said harness wire set from said wire feed means to said terminating means, said wire transport means including first and second wire clamps disposed on opposite sides of said harness wire set for clamping said harness wire set near said opposite ends thereof, said first and second wire clamps being capable of first movements in which said first and second wire clamps reciprocate along said harness assembly path between said wire feed means and said terminating means, said first and second wire clamps being further movable in second movements in which said first and second wire clamps move into and out of clamping engagement with said harness wire set from opposite sides of said harness wire set, said first and second wire clamp first and second movements being synchronized such that said first and second wire clamps do not interferingly move into said wire feed path of said wire feed means during feeding thereby of said harness wire sets, said apparatus further including means for coupling said first and second wire clamps together after they have contacted said harness wire set and for maintaining said first and second wire clamps coupled together as said wire transport means transports said harness wire set from said wire feed means to said terminating means, said first and second wire clamp coupling means including at least one engagement member disposed on one of said first and second wire clamps that engages the other of said first and second wire clamps.

2. The wire harness apparatus of claim 1, wherein said first and second wire clamps are disposed near said opposite free ends and first wire clamps are further disposed above said harness wire set and said second wire clamps are disposed beneath said harness wire set, each of said first wire clamps being aligned with a corresponding second wire clamp.

3. The wire harness apparatus of claims 2, wherein said first and second wire clamps are driven in said first and second movements by respective first and second drive assemblies that selectively reciprocatingly drive said first and second wire clamps between said wire feed means and said terminating means.

4. The wire harness apparatus of claim 3, wherein said first drive assembly includes a guide rail extending between said wire feed path and said terminating means and, a drive head movably mounted thereon, said first wire clamp being operatively connected to said drive head, said first wire clamp being further operatively connected to a first clamp actuating drive assembly that selectively moves said first wire clamp into and out of contact with said harness wire set.

5. The wire harness apparatus of claim 4, wherein said second drive assembly extends between said wire feed path and said terminating means and includes, a drive base mounted thereon, said second wire clamp being operatively connected to said drive base and movable thereon, said second wire clamp being further operatively connected to a second wire clamp actuating assembly that selectively moves said second wire clamp into and out of contact with said harness wire set, and further including means for synchronizing movement of said first and second drive assemblies such that they move in unison in their first movements between said wire feed means and said terminating means.

6. The wire harness apparatus of claim 5, wherein said first and second wire clamp actuating assemblies respectively move said first and second wire clamps in opposing vertical movement.

7. The wire harness apparatus of claim 1, wherein said first and second wire clamp coupling means engagement member includes at least one latch disposed on one of said first and second wire clamps, and a slot disposed on the other of said first and second wire clamps, said latch engaging said slot to maintain first and second wire clamps in a coupled condition.

8. The wire harness apparatus of claim 1, wherein said wire clamping means first and second movements are operatively synchronized together such that when said wire transport means is moving toward said wire feed means, said wire clamping means is moved out of contact with said harness wire set and when said wire transport means is moving from said wire feed means toward said terminating means, said wire clamping means is moved into contact with said harness wire set.

9. An apparatus for making wire harnesses, the apparatus comprising: a supply of multiple wires; means for feeding and measuring preselected lengths of wire from said wire supply, said wire feeding means feeding said wire lengths along a wire feed path, each of said wires being separated by a preselected wire-to-wire spacing; means for cutting said wires fed from said wire feeding means to define a set of harness wires having two sets of free ends on opposite ends of said harness wire set; means for terminating said connector elements to said harness wire set free ends, means for transferring said harness wire set along a wire harness assembly path from said wire feeding means to said terminating means, the wire transfer means including a wire clamping mechanism having first and second wire claps disposed on opposite sides of said harness wire set for contacting said harness wire set and maintaining said wire-to-wire spacing of said harness wire set, said wire transfer means including first and second drive means for respectively driving said first and second wire clamps in reciprocating horizontal movement between said wire feeding means and said terminating means, the wire first and second wire clamps being movable in a reciprocating horizontal movement along said wire harness assembly path between said wire feeding means and said terminating means, said first and second wire clamps being further movable in a reciprocating vertical movement in and out of contact with said harness wire set to clamp said harness wire set during movement thereof from said wire feeding means to said terminating means, said wire transfer means including means for coupling said first and second wire clamps together as said wire transfer means moves between said wire feeding means and said terminating means, said wire clamp coupling means including at least one latch disposed on one of said first and second wire clamps and a slot disposed on the other of said first and second wire clamps, said latch engaging said slot to maintain said first and second wire clamps in a coupled condition.

10. The wire harness assembly apparatus of claim 9, wherein said first and second drive assemblies are vertically aligned together along said harness assembly path.

11. The wire harness assembly apparatus of claim 10, wherein said first and second wire clamps are vertically aligned with each other.

12. The wire harness assembly apparatus of claim 10, wherein said wire clamp coupling means includes a pair of latches disposed on opposite sides of one of said first and second wire clamps and a pair of slots disposed on opposite sides of the other of said first and second wire clamps, said latches engaging said slots to maintain said first and second wire clamps in a coupled condition.

* * * * *